US006810220B2

(12) United States Patent
Hamada et al.

(10) Patent No.: US 6,810,220 B2
(45) Date of Patent: Oct. 26, 2004

(54) CONTROL FOR A FIXING DEVICE IN AN IMAGE FORMING APPARATUS

(75) Inventors: Toshiyuki Hamada, Osaka (JP); Makoto Eki, Osaka (JP); Yuzuru Nanjo, Osaka (JP); Takashi Maekawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/407,268

(22) Filed: Apr. 7, 2003

(65) Prior Publication Data

US 2003/0190170 A1 Oct. 9, 2003

(30) Foreign Application Priority Data

Apr. 9, 2002 (JP) ..... 2002-105981

(51) Int. Cl.[7] ..... G03G 15/20; H05B 1/00

(52) U.S. Cl. ..... 399/69; 219/216; 219/470; 399/70; 399/334

(58) Field of Search ..... 399/69, 70, 328, 399/334; 219/216, 469, 470

(56) References Cited

U.S. PATENT DOCUMENTS 5,512,993 A * 4/1996 Endo et al. ..... 219/216
5,819,134 A * 10/1998 Sato et al. ..... 399/69
5,854,959 A * 12/1998 Mirabella, Jr. ..... 399/69
6,289,185 B1 * 9/2001 Cahill ..... 399/69
6,311,028 B1 * 10/2001 Matsudaira ..... 399/69
6,453,131 B1 * 9/2002 Sasai ..... 399/70
6,490,423 B2 * 12/2002 Horobin et al. ..... 399/69
6,516,165 B2 * 2/2003 Makihira et al. ..... 399/69
6,539,185 B2 * 3/2003 Hanyu et al. ..... 399/69
6,603,936 B2 * 8/2003 Murata et al. ..... 399/69
6,643,477 B2 * 11/2003 Mitsuoka et al. ..... 399/69

* cited by examiner

*Primary Examiner*—Fred Braun
(74) *Attorney, Agent, or Firm*—Smith, Gambrell & Russell, LLP

(57) ABSTRACT

An image forming apparatus which includes a fixing device including a fixing roller, a pressure roller pressed into contact with the fixing roller, and a thermistor in contact with a non-paper-passage region on the surface of the fixing roller, the fixing roller incorporating a first halogen heater whose heat distribution based on the axial direction of the fixing roller is set such that heat in a middle region thereof is higher than heat in opposite-end regions thereof, and a second halogen heater whose heat distribution based on the axial direction of the fixing roller is set such that heat in opposite-end regions thereof is higher than heat in a middle region thereof; and a controller for controlling power supply to the first and second halogen heaters. The controller starts power supply to the first and second halogen heaters to start warm-up of the fixing device, and cuts off power supply to the first halogen heater for a predetermined period of time during the warm-up.

5 Claims, 5 Drawing Sheets

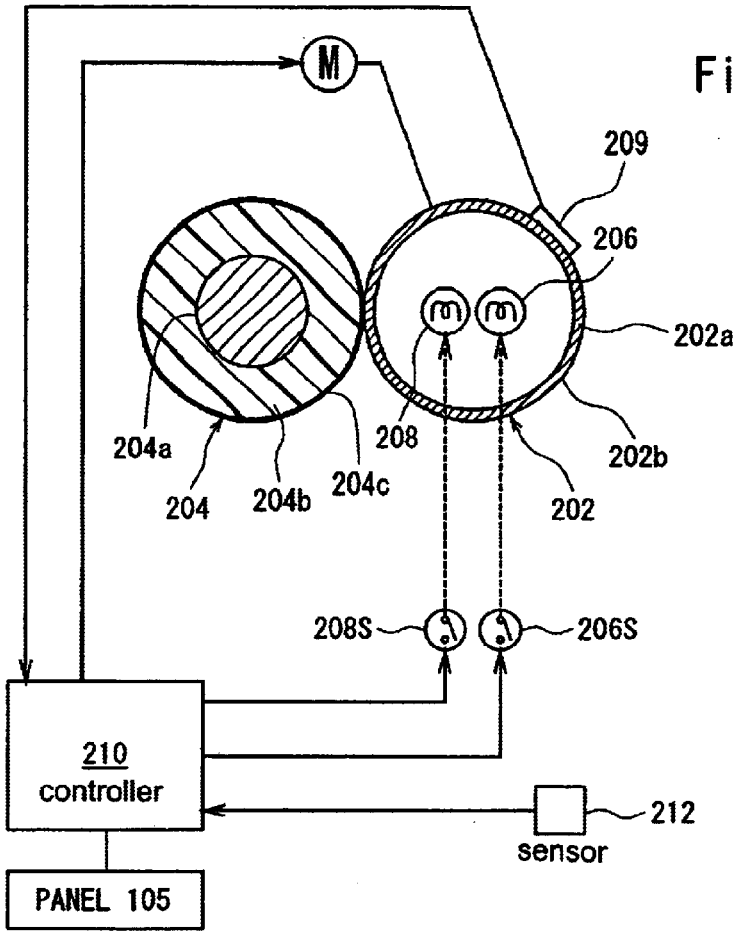
Fig. 4
Fig. 5
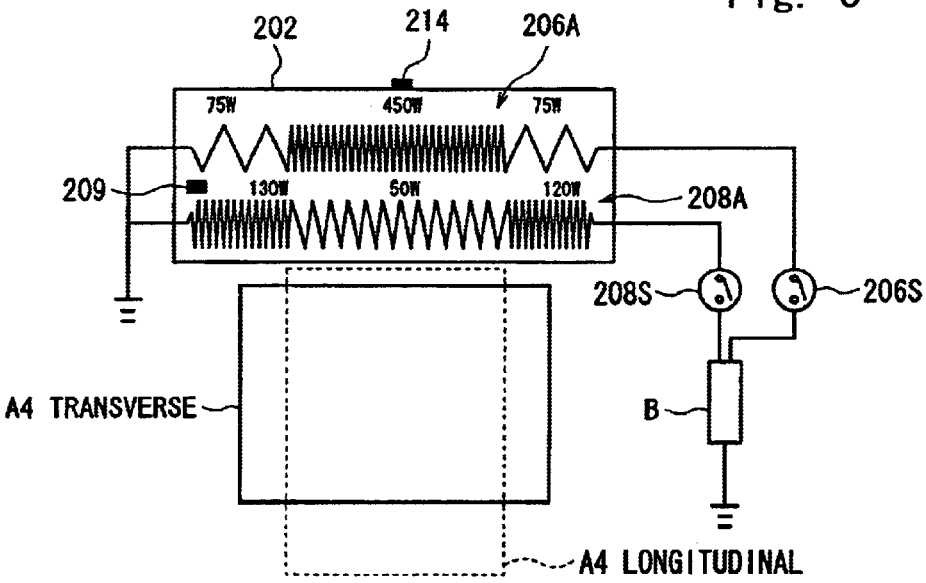

CONTROL FOR A FIXING DEVICE IN AN IMAGE FORMING APPARATUS

FIELD OF THE INVENTION

This invention relates to an image forming apparatus using a fixing device which passes a piece of paper (may hereinafter referred to as paper) bearing an unfixed toner image through the nip between a pair of heated rollers to heat and fuse an unfixed toner on the paper, thereby fixing the toner image onto the paper. More specifically, the invention relates to an image forming apparatus using a fixing device which controls energization of heating means based on the detected value of the roller surface temperature in a non-paper-passage region.

DESCRIPTION OF THE PRIOR ART

A conventional electrophotographic image forming apparatus uses a heat roller fixing system under which paper bearing an unfixed toner image is passed through the nip between at least a pair of rollers heated by heating means incorporated in a fixing roller which makes contact with an unfixed toner on the paper, among nip-forming roller pairs, whereby the toner on the paper is fixed. Under this heat roller fixing system, the surface temperature of the fixing roller needs to be heated to a temperature high enough to heat the toner on the paper, softening and melting the toner for fixing onto the paper. In order that the toner is fully softened in a short time during which the paper passes through the roller nip, the fixing roller is generally maintained at 140 to 210° C., a temperature range several tons of degrees higher than the softening temperature of the binder resin contained in the toner. Heating means, such as a halogen heater, is incorporated within the fixing roller to heat the fixing roller. In order to maintain the surface temperature of the fixing roller uniformly regardless of the size of paper, a plurality of halogen heaters different from each other in heat distribution in the axial direction of the fixing roller are often incorporated in the fixing roller.

It is common practice to combine a middle region-emphasized halogen heater for heating the middle region of the fixing roller emphatically, and an opposite end region-emphasized halogen heater for heating the opposite end regions of the fixing roller emphatically. In the case of paper with a maximum width based on the axial direction of the fixing roller, the combined use of these heaters adjusts the entire paper-passage region of the fixing roller at a uniform temperature. The temperature of the fixing roller is set such that the temperature distribution during paper passage is uniform in the axial direction of the fixing roller. Thus, during a warm-up when no paper is passed, the middle region of the fixing roller is always at a high temperature, because of heat conduction to the non-paper-passage region or heat dissipation from the opposite end portions of the fixing roller. To provide a reference for heating control which maintains the temperature of the fixing roller at a constant fixing temperature, temperature detection means, such as a thermistor, for detecting the surface temperature of the fixing roller is brought into contact with a suitable position of the surface of the fixing roller. A thermistor has so far been mounted mostly so as to contact the surface of the fixing roller over which paper is actually passed. In this case, upon rubbing with the thermistor, the surface of the fixing roller is damaged, so that a paper release effect is impaired, diminishing the component life. Thus, the thermistor is mounted in the non-paper-passage region in an increasing number of embodiments.

However, the halogen heater is provided so as to heat the paper-passage region mainly. Thus, the thermistor in the non-paper-passage region is heated later than the paper-passage region. During a warm-up after the power is turned on, heating is continued, without passage of paper. At a time when the thermistor detects the fixing temperature, therefore, the surface temperature in the paper-passage region of the fixing roller rises excessively, posing the problems of a hot offset and a waste of power. To avoid these problems, the temperature in the middle region of the fixing roller may be kept down. In this case, the temperature in the opposite-end regions of the fixing roller may fail to reach the fixing temperature, causing a failure in fixing.

SUMMARY OF THE INVENTION

An object of the present invention is to provide an image forming apparatus equipped with a fixing device in which temperature detection means for the surface of a fixing roller is provided in a non-paper-passage region, the image forming apparatus being capable of preventing an excessive rise in the surface temperature of the middle region of the fixing roller during a warm-up.

Another object of the present invention is to provide an image forming apparatus equipped with a fixing device in which temperature detection means for the surface of a fixing roller is provided in a non-paper-passage region, the image forming apparatus being capable of preventing a hot offset in the middle region of the fixing roller and a failure in fixing in opposite-end regions of the fixing roller.

Yet another object of the present invention is to provide an image forming apparatus equipped with a fixing device in which a plurality of heating means are incorporated in a fixing roller and temperature detection means for the surface of the fixing roller is provided in a non-paper-passage region, the image forming apparatus being capable of heating the fixing roller such that the surface temperature of the fixing roller during a warm-up is uniform in the axial direction.

According to the present invention, there is provided an image forming apparatus comprising: a fixing device including a fixing roller, a pressure roller pressed into contact with the fixing roller, and temperature detection means in contact with a non-paper-passage region on the surface of the fixing roller, the fixing roller incorporating first heating means whose heat distribution based on the axial direction of the fixing roller is set such that heat in a middle region thereof is higher than heat in opposite-end regions thereof, and second heating means whose heat distribution based on the axial direction of the fixing roller is set such that heat in opposite-end regions thereof is higher than heat in a middle region thereof; and a controller for controlling power supply to the first heating means and the second heating means, and wherein the controller starts power supply to the first heating means and the second heating means to start warm-up of the fixing device, and cuts off power supply to the first heating means for a predetermined period of time during the warm-up.

Preferably, the controller cuts off power supply to the first heating means for the predetermined period of time at a time when the temperature of the non-paper-passage region detected by the temperature detection means reaches a predetermined value during the warm-up.

Preferably, the controller cuts off power supply to the first heating means for the predetermined period of time during the warm-up, then restores power supply to the first heating means, and continues power supply to the first heating means and the second heating means until a predetermined time when the warm-up is completed.

Preferably, ambient temperature detection means is provided, and the controller sets the duration of the warm-up based on the ambient temperature detected by the ambient temperature detection means.

Preferably, the controller cuts off power supply to the first heating means for the predetermined period of time during the warm-up, then restores power supply to the first heating means, and at a time when the temperature of the non-paper-passage region detected by the temperature detection means reaches a predetermined value, cuts off power supply to the first heating means and the second heating means, thereby completing the warm-up.

BRIEF DESCRIPTION OF THE DRAWINGS

FIG. 4 is a schematic configuration drawing schematically showing the relationship between a controller and the internal construction of a fixing device provided in the copier illustrated in FIG. 1;

FIG. 5 is a view schematically showing the positional relationship among the heat distributions (power consumptions) of halogen heaters within a fixing roller, a paper-passage region, and a thermistor for detecting the temperature on the surface of the fixing roller;

DETAILED DESCRIPTION OF THE PREFERRED EMBODIMENTS

Embodiments of an electrostatic copier constructed according to the present invention, and more specifically, embodiments of an electrostatic copier of the in-body paper delivery type, will now be described in detail with reference to the accompanying drawings.

Figure 1:
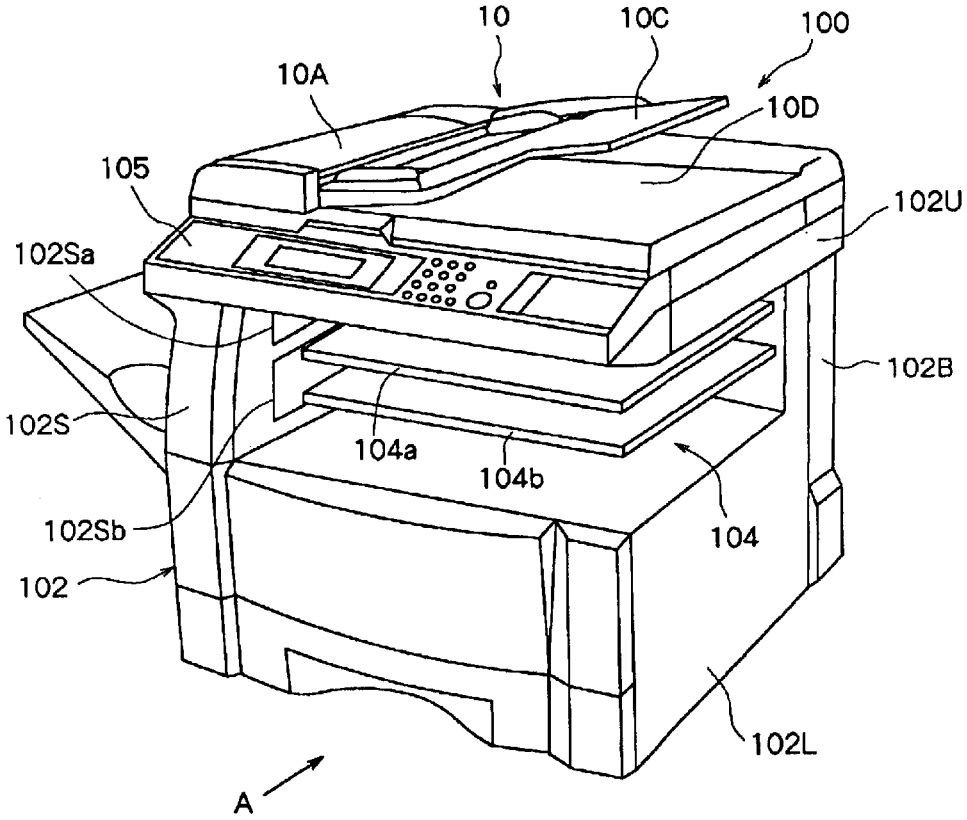
FIG. 1 is a perspective view showing an external outline configuration of an electrostatic copier of an in-body paper delivery type as an embodiment of an image forming apparatus according to the present invention.
Figure 2:
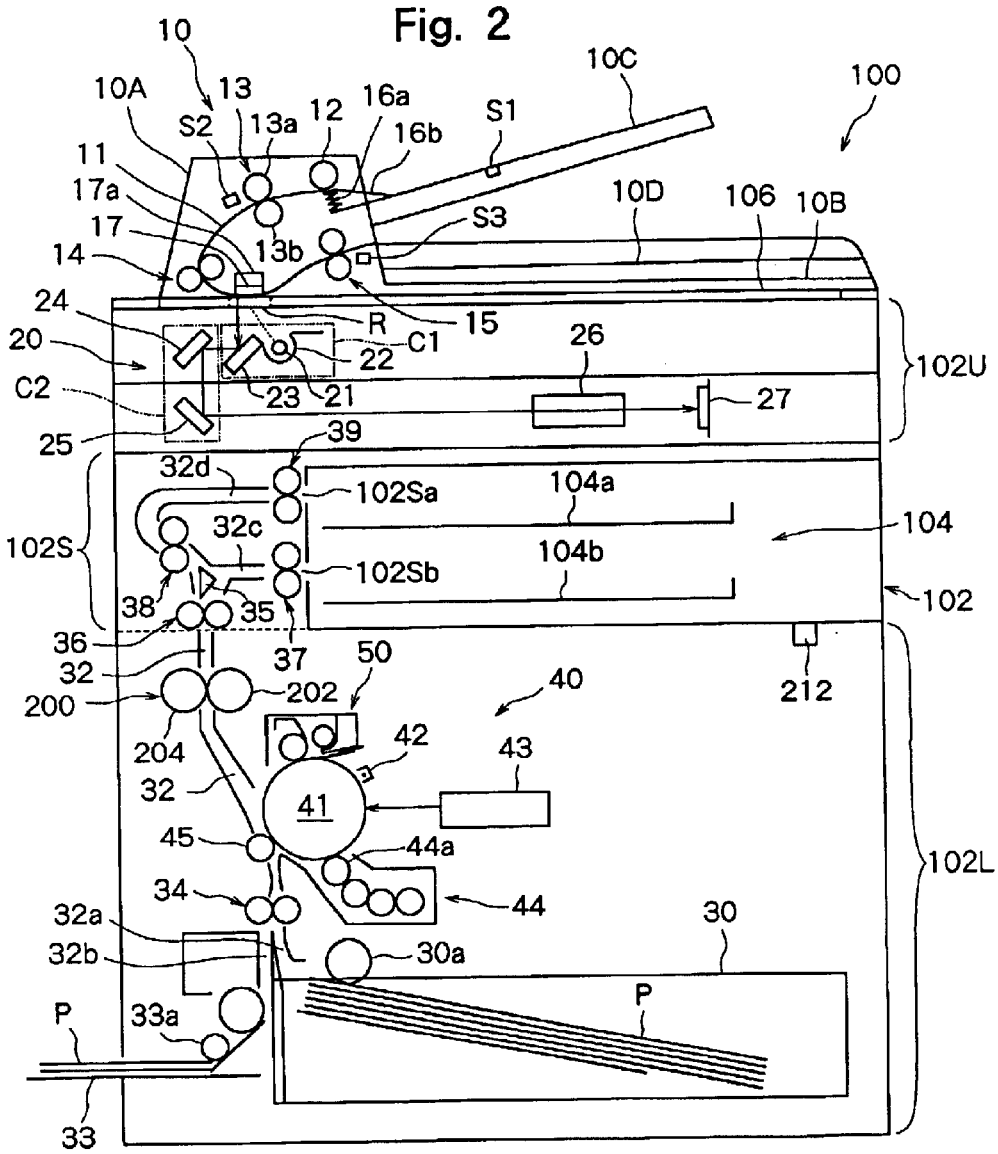
FIG. 2 is a front view of the copier shown in FIG. 1 as a sectional schematic view showing an internal construction.

With reference to FIGS. 1 and 2, a copier 100 has a copier body 102 having a nearly rectangular parallelopipedal contour as a whole. The copier body 102 has a lower body 102L, an upper body 102U disposed above the lower body 102L and at a distance therefrom, and a one-side portion connecting body 102S and a rear end portion connecting body 102B which connect the lower body 102L and the upper body 102U integrally to each other. When the copier body 102 is viewed from front (viewed in the direction of an arrow A in FIG. 1; viewed from the sheet face of FIG. 2), the one-side portion connecting body 102S extends vertically between one-side portions of the lower body 102L and the upper body 102U (between their left side portions in FIGS. 1 and 2) to connect these one-side portions, while the rear end portion connecting body 102B extends vertically between rear end portions of the lower body 102L and the upper body 102U to connect these rear end portions. The upper body 102U is present in an upper end portion of the copier body 102. In a space between the lower body 102L and the upper body 102U in the copier body 102, a paper stack space portion 104 is formed which is open at the front surface and the other side surface of the copier body 102 when the copier body 102 is viewed from front. The bottom surface of the paper stack space portion 104 comprises a horizontal upper surface of the lower body 102L, while the top surface of the paper stack space portion 104 comprises a horizontal lower surface of the upper body 102U. In the paper stack space portion 104, an upper paper receiving tray 104*a* and a lower paper receiving tray 104*b* are horizontally disposed with spacing in an up-down direction. In the one-side portion connecting body 102S, an upper paper outlet opening 102S*a* and a lower paper outlet opening 102S*b* are disposed with spacing in the up-down direction. Paper transported through a paper transport passage 32 (to be described later on) is let out onto the upper paper receiving tray 104*a* or the lower paper receiving tray 104*b* through the upper paper outlet opening 102S*a* or the lower paper outlet opening 102S*b*, respectively. As described herein, compactness of image forming means is required of a so-called in-body paper delivery type image forming apparatus having a paper delivery portion within an image forming apparatus body, out of the necessity for providing a space occupied by a paper stack space portion. In a developing device as well, a single-component development system compact in size and low in cost is advantageous.

Figure 3:
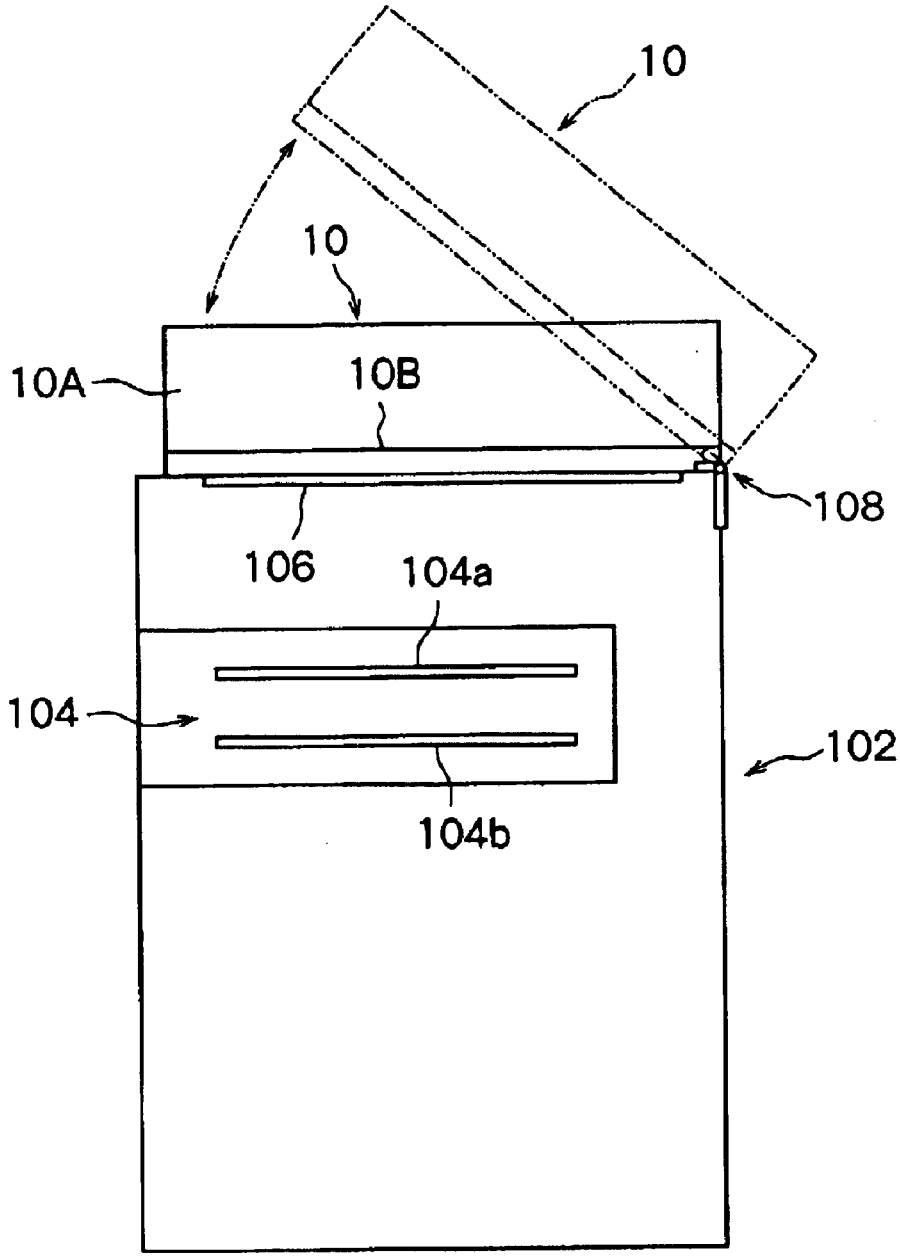
FIG. 3 is a schematic view of the copier shown in FIG. 1, as viewed from the right in FIG. 1, illustrating the open and closed states of a document feeder.

An operating panel 105 is disposed in a front region, opposed to an operator, of the upper surface of the upper body 102U, and a document bearing board 106 comprising a transparent glass plate is horizontally disposed in the other wide region of the upper surface of the upper body 102U. A document feeder 10 for transporting a document to an image reading position R so that the image of the document may be read is pivotally disposed on the upper body 102U. The document feeder 10 includes a document feeder body 10A, a document cover 10B, a document feeding tray 10C, and a document receiving tray 10D. The document cover 10B is formed integrally with the document feeder body 10A, and extends rightwardly horizontally in FIG. 2 from a lower end portion of the document feeder body 10A. The lower surface of the document cover 10B and the lower surface of the document feeder body 10A are existent on the same plane. The document receiving tray 10D is formed integrally with the upper surface of the document cover 10B. The document feeding tray 10C is disposed in the document feeder body 10A so as to extend obliquely upwardly to the right in FIG. 2 from an upper end portion of the document feeder body 10A. As shown in FIG. 3, the document feeder 10 is supported on the upper body 102U so as to be pivotable via hinge means 108 disposed on a rear side of the upper body 102U. The document feeder 10 is pivotable between a closed position indicated by solid lines in FIG. 3 and an open position indicated by two-dot chain lines in FIG. 3. When located at the closed position, the document feeder 10 covers the entire surface of the document bearing board 106 from above. When located at the open position, the document feeder 10 makes the entire surface of the document bearing board 106 open upwardly.

The document feeder 10, when located at the closed position, will be described further. A document transport passage 11 is disposed inside the document feeder body 10A. The document transport passage 11 extends obliquely downwardly to the left from a right-hand upper end portion of the document feeder body 10A in FIG. 2, curves and reverses toward the image reading position R disposed in a left end portion of the document bearing board 106, and then extends obliquely upwardly to the right toward a right-hand lower end portion of the document feeder body 10A in FIG. 2. The document feeding tray 10C is disposed on an extension of the upstream end of the document transport passage 11, and the document receiving tray 10D extends on an extension of the downstream end of the document transport passage 11. In the document feeder body 10A, a pickup roller 12, a transport roller pair 13, a register roller pair 14, and an outlet roller pair 15 are provided in this order along the document transport passage 11 from an upstream region toward a downstream region in the direction of document transport. The transport roller pair 13 is composed of a drive roller 13*a* and a separation roller 13*b*. The separation roller 13*b* rotationally moves in a direction opposite to the drive roller 13*a* at the site of nip only when the rotation load falls short of a predetermined torque. When the rotation load exceeds the predetermined torque, the separation roller 13*b* rotates following the drive roller 13*a*. A spring member 16*a* and a set document pressing member 16*b* are disposed in an upstream end region of the document transport passage 11 and nearly below the pickup roller 12. The set document pressing member 16*b* is urged upward toward the pickup roller 12 by the spring member 16*a*.

The image reading position R is provided between the register roller pair 14 and the outlet roller pair 15 in the document transport passage 11. At the image reading position R, the document transport passage 11 is formed by cooperation between the document feeder body 10A and the document bearing board 106. A white reference plate 17 for shading correction, and document hold-down means 17*a* are disposed in the document feeder body 10A. The white reference plate 17 is opposed to the document bearing board 106 from above at the image reading position R. The document hold-down means 17*a* is disposed on the upper side of the white reference plate 17 to press the white reference plate 17 against the upper surface of the document bearing board 106.

A plurality of sensors are disposed in the document feeder 10. That is, a document setting detection sensor S1 is disposed in a middle portion of the document feeding tray 10C, a feeding sensor S2 is disposed downstream from the transport roller pair 13, and a document outletting sensor S3 is disposed downstream from the outlet roller pair 15.

In the upper body 102U, document exposure/image reading means 20 is disposed for exposing the document, which is transported through the document transport passage 11 by the document feeder 10, to light at the image reading position R and reading the image of the document. As shown in FIG. 2, the document exposure/image reading means 20 includes an exposure lamp 21, a reflecting plate 22 for reflecting light from the exposure lamp 21, a first mirror 23, a second mirror 24 and a third mirror 25 for receiving reflected light from the document passing the image reading position R and reflecting this light, a condenser lens 26, and an image sensor, e.g. a line type CCD, 27. The exposure lamp 21, the reflecting plate 22, and the first mirror 23 are loaded on a first carriage C1 which is movable in a right-left direction in FIG. 2. The second mirror 24 and the third mirror 25 are loaded on a second carriage C2 which is movable in the right-left direction in FIG. 2.

The copier 100 adopts two methods for reading the image of the document, a so-called sheet through method and a document fixing method. According to the sheet through method, with the document feeder 10 being located at the closed position, the image of the document passing the image reading position R is relatively scanned and read by the document exposure/image reading means 20 while the first carriage C1 and the second carriage C2 are being kept at a predetermined image reading stationary position (the position shown in FIG. 2). When the first carriage C1 and the second carriage C2 are at a standstill at the image reading stationary position shown in FIG. 2, the exposure lamp 21, the reflecting plate 22 and the first mirror 23 loaded on the first carriage C1 are positioned in a region nearly directly below the image reading position R. According to the document fixing method, on the other hand, with the document being placed on the upper surface of the document bearing board 106 and the document feeder 10 being located at the closed position, the first carriage C1 and the second carriage C2 are each moved, whereby the image of the document stopped on the upper surface of the document bearing board 106 is scanned and read by the document exposure/image reading means 20. The image of the document placed on the document bearing board 106 undergoes reading scanning by the document exposure/image reading means 20, and is thereby focused in a reduced size onto the CCD 27, whereby it is converted into electrical signals by photoelectric conversion. Both types of reading the image of the document are available for the copier 100. operations of the document feeder 10 and the document exposure/image reading means 20 will be described in accordance with the above-mentioned sheet through method. With reference to FIG. 2, with the document feeder 10 being located at the closed position, n documents set on the document feeding tray 10C, with their image surfaces facing upward, are pressed against the pickup roller 12 at a predetermined pressure by the set document pressing member 16*b* urged upward by the spring member 16*a*. When a copy start button (not shown) disposed on the operating panel 105 is depressed into the ON-state, the pickup roller 12 and the transport roller pair 13 are rotationally driven by primary feeding drive means (not shown). The documents set on the document feeding tray 10C are sent, usually in plural numbers, starting with the upwardly facing side of the documents, to the transport roller pair 13 by the pickup roller 12. Of the plural documents sent to the transport roller pair 13, only the uppermost one document is separated by the separation roller 13*b*, and transported toward the register roller pair 14. After the front end of this document is detected by the feeding sensor S2 and then transported over a predetermined distance, the operation of the primary feeding drive means is stopped to halt the rotational driving of the transport roller pair 13 and the pickup roller 12, thus completing primary feeding. The document is stopped, with its front end being compressed by the nip of the register roller pair 14, and with a warp being formed at the front end.

A predetermined time after completion of primary feeding, secondary feeding is started. That is, the transport roller pair 13, the register roller pair 14, and the outlet roller pair 15 are rotationally driven by the operation of secondary feeding drive means (not shown). The document is transported toward the image reading position R and the outlet roller pair 15 by the register roller pair 14, and then finally let out onto the document receiving tray 10D by the outlet roller pair 15. When the document outletting sensor S3 provided downstream from the outlet roller pair 15 detects the passage of the rear end of the document, it can be determined that the image reading of one document has been completed. The document outletting sensor S3 has the counting function of counting the number of the documents whenever it detects the passage of the rear end of the document. If the document setting detection sensor S1 senses following documents, the transport of the second and subsequent documents is continued. The document, when passing the image reading position R, is transported while being pressed lightly against the surface of the document bearing board 106 by the white reference plate 17 and the document hold-down means 17*a*. During this transport, the image surface of the document is relatively exposed and scanned by the exposure lamp 21 of the document exposure/image reading means 20 which is opposed to the document, with the document bearing board 106 being sandwiched therebetween.

More concretely, the first carriage C1 and the second carriage C2 are held at the aforementioned image reading stationary position when the image of the document is to be read by the document exposure/image reading means 20. Light emitted from the exposure lamp 21 relatively scans the document passing the image reading position R. Reflected light from the document reaches the CCD 27 via the first mirror 23, the second mirror 24, the third mirror 25, and the condenser lens 26. As a result, the image of the document passing the image reading position R on the upper surface of the document bearing board 106 is relatively read and scanned by the document exposure/image reading means 20, focused in a scaled-down size onto the CCD 27, and converted into electrical signals by photoelectric conversion.

With further reference to FIG. 2, a paper feeding cassette 30 accommodating pieces of paper, image forming means 40 for forming an image on the paper, a fixing device 200, and a paper transport passage 32 are disposed in the lower body 102L of the copier body 102. The paper feeding cassette 30 is housed in a lower end portion of the lower body 102L so as to be withdrawable toward an operator in front of the copier 100. A manual paper feeding tray 33 is disposed in a left-hand lower end portion of the lower body 102L in FIG. 2 so as to be openable and closable.

The image forming means 40 disposed above the paper feeding cassette 30 includes a photoconductor drum 41, and a main charger 42, a laser scanning unit 43, a developing device 44, a transfer roller 45 as transfer means, and a cleaning device 50 which are disposed around the photoconductor drum 41. The paper transport passage 32 extends vertically beside (in FIG. 2, on the left side of) the photoconductor drum 41. Because of this layout, a transfer zone is disposed nearly laterally of the circumferential surface of the photoconductor drum 41 (in FIG. 2, at a position nearly to the left of the circumferential surface and slightly below the center in the up-down direction of the circumferential surface), and the transfer roller 45 is in pressurized contact with the circumferential surface in the transfer zone. The cleaning device 50 is disposed above the photoconductor drum 41, and has a lower end portion open downward toward the circumferential surface of the photoconductor drum 41.

Two paper transport passages 32*a* and 32*b* merge with the upstream end of the paper transport passage 32. The upstream end of the paper transport passage 32*a* is connected to the paper feeding cassette 30, while the upstream end of the paper transport passage 32*b* is connected to the manual paper feeding tray 33. In the lower body 102L, there are also disposed a feed roller 30*a* for feeding pieces of paper P, accommodated in the paper feeding cassette 30, one by one to the paper transport passage 32 via the paper transport passage 32*a*, and a feed roller 33*a* for feeding pieces of paper P, set in the manual paper feeding tray 33, one by one to the paper transport passage 32 via the paper transport passage 32*b*. In the lower body 102L, a register roller pair 34 is disposed in the paper transport passage 32 upstream from the photoconductor drum 41 and at the position of merger between the paper transport passages 32*a* and 32*b*. On the paper transport passage 32, the fixing device 200 is disposed downstream from the photoconductor drum 41. The fixing device 200 includes a fixing roller 202 and a pressure roller 204. The fixing device 200 will be described in detail later.

The paper transport passage 32 further extends vertically upwardly into the one-side portion connecting body 102S, and branches into two paper transport passages 32*c* and 32*d* within the one-side portion connecting body 102S. A branching pawl 35 is disposed at the position of branching of the paper transport passages 32*c* and 32*d*. The paper transport passage 32*c* extends horizontally transversely (rightwardly in FIG. 2) from the position of branching, and is connected to the lower paper outlet opening 102S*b*. The paper transport passage 32*d* extends obliquely upwardly in FIG. 2 from the position of branching, then extends horizontally transversely (rightwardly in FIG. 2), and is connected to the upper paper outlet opening 102S*a*. Within the one-side portion connecting body 102S, a transport roller pair 36 is disposed directly upstream from the position of branching in the paper transport passage 32. An outlet roller pair 37 is disposed at the downstream end of the paper transport passage 32*c* and at a position directly upstream from the lower paper outlet opening 102S*b*. In the paper transport passage 32*d*, a transport roller pair 38 is disposed directly downstream from the position of branching, and an outlet roller pair 39 is disposed at the downstream end of the paper transport passage 32*d* and at a position directly upstream from the upper paper outlet opening 102S*a*. The branching pawl 35 is selectively switched by an actuator (not shown) between a first position indicated by solid lines in FIG. 2 and a second position (not shown).

In the image forming means 40, the photoconductor drum 41 comprises a positively chargeable a-Si-based photoconductor drum having an outer diameter of 40 mm, and is rotationally driven by drive means (not shown) clockwise in FIG. 2 at a speed of 178 mm/sec. In this copier 100, no drum heater for dealing with image streaming is provided near the photoconductor drum 41 to save energy. The circumferential surface of the photoconductor drum 41 is uniformly charged to +250 V by a corona discharge generated from the main charger 42 having a high voltage of 5 KV applied thereto. On the uniformly charged circumferential surface of the photoconductor drum 41, an electrostatic latent image comprising portions of a light potential of +10 V and a dark potential of +250 V is formed by laser light thrown from the laser scanning unit 43 in correspondence with the document image read by the CCD 27. In accordance with the rotation of the photoconductor drum 41, the electrostatic latent image is moved to a development zone formed by the photoconductor drum 41 in cooperation with a development sleeve to be described later on.

The developing device 44 has a developing roller 44*a*, and the developing roller 44*a* has a development sleeve of stainless steel and a stationary magnet disposed within the development sleeve. In the development zone, the circumferential surface of the development sleeve is opposed to the circumferential surface of the photoconductor drum 41 with a clearance of 300 $\mu$m. The development sleeve has an outer diameter of 20 mm, and is rotationally driven by drive means (not shown) so as to be rotationally moved in the development zone at a speed of 360 mm/second in the same direction as the photoconductor drum 41. The interior of the developing device 44 is filled with a positively charged magnetic toner having a volume averaged particle size of 9 μm (a median size by a coulter counter). A thin layer of the toner is formed on the circumferential surface of the development sleeve by a smoothing blade (not shown). A developing bias voltage, which comprises a direct current voltage of +100 V and an alternating current electric field with a frequency of 2 KHZ and a peak-to-peak voltage of 2 KV superimposed thereon, is applied to the developing roller 44*a*. The toner transported to the development zone is flied from the circumferential surface of the development sleeve by this developing bias to develop the electrostatic latent image formed on the circumferential surface of the photoconductor drum 41.

The pieces of paper P, which have been fed one by one from the paper feeding cassette 30 or the manual paper feeding tray 33 toward the paper transport passage 32, are moved in synchronism with the approach of the toner image formed on the circumferential surface of the photoconductor drum 41 to the transfer zone formed by the photoconductor drum 41 in cooperation with the transfer roller 45. That is, the timing of transporting the paper is adjusted by the register roller pair 34 in synchronism with the approach, and the paper is transported through the transfer zone between the photoconductor drum 41 and the transfer roller 45 along the paper transport passage 32. The paper P is passed through the transfer zone, with the front end of the paper P in alignment with the front end of the toner image formed on the circumferential surface of the photoconductor drum 41, whereby most of the toner in the toner image is transferred onto the paper P. The untransferred toner, remaining on the circumferential surface of the photoconductor drum 41 without transferring onto the paper P, is removed, as will be described later, by the cleaning device 50 in accordance with the rotation of the photoconductor drum 41. The paper P having the toner image transferred thereto is transported toward the fixing device 200 vertically upwardly along the paper transport passage 32 extending vertically beside the photoconductor drum 41. During the passage of the paper P between the fixing roller 202 and the pressure roller 204 of the fixing device 200, the toner image transferred onto the paper P is fixed.

The paper P having the toner image fixed is further transported vertically upwardly along the paper transport passage 32. If the branching pawl 35 is switched to the first position indicated by the solid lines in FIG. 2, the paper P is introduced into the paper transport passage 32*c* by the transport roller pair 36, and let out by the outlet roller pair 37 onto the lower paper receiving tray 104*b* of the paper stack space portion 104 through the lower paper outlet opening 102S*b*. If the branching pawl 35 is switched to the second position (not shown), on the other hand, the paper P is introduced into the paper transport passage 32*d* by the transport roller pairs 36 and 38, and let out by the outlet roller pair 39 onto the upper paper receiving tray 104*a* of the paper stack space portion 104 through the upper paper outlet opening 102S*a*. In FIG. 2, the numeral 212 denotes an ambient temperature detection sensor for detecting the ambient temperature. The ambient temperature detection sensor 212 may be disposed at a suitable position within the copier body 102, and in the illustrated embodiment, is mounted on a ceiling portion within the lower body 102L.

Next, the internal structure of the fixing device 200 will be described with reference to FIG. 4. FIG. 4 is a view of the fixing device 200 as viewed from the front of the copier 100 (a view taken when the sheet of FIG. 2 is viewed from face to back). As shown in FIG. 4, the fixing device 200 comprises the fixing roller 202, the pressure roller 204, and a thermistor 209 as detection means for detecting the surface temperature of the fixing roller 202. The pressure roller 204 is pressed into contact with the fixing roller 202 by spring means (not shown), and a nip portion for fixing is formed between the pressure roller 204 and the fixing roller 202. A first halogen heater (halogen lamp) 206 constituting first heating means, and a second halogen heater (halogen lamp) 208 constituting second heating means are provided within the fixing roller 202. In the copier body 102, a controller 210 is provided which supplies electric power to the first halogen heater 206 and the second halogen heater 208 based on the temperature detected by the thermistor 209, and which controls the rotational drive to the fixing roller 202. In the descriptions to follow, the first halogen heater 206 is simply referred to as the halogen heater 206, and the second halogen heater 208 is simply referred to as the halogen heater 208.

The fixing roller 202 is composed of a roller body 202*a* made of aluminum, and a PTFE layer 202*b* coated on the surface of the roller body 202*a*. The roller body 202*a* has an outer diameter of 37 mm and a wall thickness of 1 mm. The PTFE layer 202*b* coated for enhanced paper release properties has a thickness of 25 μm. The fixing roller 202 is rotationally driven by an electric motor M as a drive source, and the electric motor M is controlled by the controller 210 so as to drive the fixing roller 202 at a peripheral speed of 178 mm/sec equal to that of the photoconductor drum 41. The electric motor M and the fixing roller 202 are drivingly connected by a drive force transmission mechanism (not shown) including gears.

The pressure roller 204 is composed of a mandrel 204*a* made of iron, an elastic layer 204*b* coated on the surface of the mandrel 204*a*, and a PFA tube layer 204*c* coated on the surface of the elastic layer 204*b*. The mandrel 204*a* has an outer diameter of 20 mm. The elastic layer 204*b* is formed from a foam of silicon rubber having an Asker C hardness of 55 degrees and a thickness of 5 mm. The PFA tube layer 204*c* for enhanced paper release properties has a thickness of 50 μm. As stated earlier, the pressure roller 204 is pressed into contact with the fixing roller 202 by the spring means (not shown). Thus, when the fixing roller 202 is rotationally driven, the pressure roller 204 is rotated to follow the rotations of the fixing roller 202.

The controller 210 is composed of a microcomputer, and includes a central processing unit (CPU) for performing computations in accordance with a control program, a ROM storing the control program, a RAM storing the results of computations and capable of reading and writing, a timer, a counter, an input interface, and an output interface. The input interface of the thus constructed controller 210 receives detection signals from the thermistor 209, the ambient temperature detection sensor 212, a copy start button and paper size setting keys (not shown) provided on the operating panel 105, and other detectors and switches (not shown). The output interface of the controller 210 outputs control signals to the electric motor M, and switches 206S and 208S (to be described later) for the halogen heaters 206 and 208.

With reference to FIG. 5, the positional relationship between the heat distribution, i.e., electric power allocation, of the halogen heaters within the fixing roller 202, the region of paper passage, and the thermistor 209 for detecting the surface temperature of the fixing roller 202 will be explained schematically. In FIG. 5, the left is the front of the copier 100, and the right is the rear of the copier 100.

As described earlier, the pair of halogen heaters 206 and 208 are incorporated in a stationary state in the hollow interior of the fixing roller 202 so as to extend in the axial direction of the fixing roller 202. The halogen heater 206 includes a quartz glass tube (not shown), and a coiled filament 206A mounted within the quartz glass tube. One end of the filament 206A is connected to a power supply device B via the switch 206S, and the other end of the filament 206A is grounded. Similarly, the halogen heater 208 includes a quartz glass tube (not shown), and a coiled filament 208A mounted within the quartz glass tube. One end of the filament 208A is connected to the power supply device B via the switch 208S, and the other end of the filament 208A is grounded. Both ends (not shown) of the quartz glass tubes of the halogen heaters 206 and 208 are supported by the housing of the fixing device 200 via support means.

The halogen heater 206 consumes 600W of power, and has a heat distribution, i.e., allocation of power consumption, such that the middle region of the halogen heater 206 is heated emphatically. The allocation of power consumption in the filament 206A, a heating element, is set such that 450W is allocated to the middle region, and 75W is allocated to each of the opposite-end regions. The length of the middle region of the heating element is set at about 210 mm, and is consistent with the region where paper of the A4 size under JIS (297 mm×210 mm) passes in a longitudinal posture.

The halogen heater 208 consumes 300W of power, and has such a heat distribution that the opposite-end regions are heated emphatically. The allocation of power consumption in the filament 208A, a heating element, is set such that 130W is allocated to a one-end region (front region), 120W to the other end region (rear region), and 50 W to the middle region. The length of the middle region of the heating element is set at about 210 mm, and is consistent with the region where paper of the A4 size under JIS (297 mm×210 mm) passes in a longitudinal posture.

The entire lengths of the heating elements of the halogen heaters 206 and 208 are each 310 mm, and the opposite end portions of the heating elements are positioned in alignment so as to be capable of covering the region where A4-size paper (297 mm×210 mm) passes in a transverse posture.

The thermistor 209 for detecting the surface temperature of the fixing roller 202 is provided at a position which is included in the front region of the fixing roller 202 where no paper passes (hereinafter referred to as the non-paper-passage region), and which is also included in the heating region of the heating elements of the halogen heaters 206 and 208. The thermistor 209 is disposed in the housing (not shown) of the fixing device 200, and a temperature detection portion (not shown) of the thermistor 209 is brought into contact with the surface of the fixing roller 202.

In the embodiment of the present invention, in order to detect the surface temperature distribution in the axial direction of the fixing roller 202, the effect of attaining the objects of the present invention was investigated by providing, for convenience's sake, a thermistor 214 for measuring the temperature of the middle portion of the fixing roller 202. The thermistor 214 is disposed in the housing (not shown) of the fixing device 200, and a temperature detection portion (not shown) of the thermistor 214 is brought into contact with the surface of nearly the middle portion of the fixing roller 202. In the descriptions to follow, the temperature detected by the thermistor 209 is called a non-paper-passage region temperature, and the temperature detected by the thermistor 214 is called a roller middle region temperature.

In the copier 100, a power supply switch (not shown) for the copier 100 is provided in the copier body 102. When the power supply switch is turned on, the controller 210, according to the settings stored, drives the electric motor M to drive the fixing roller 202 rotationally, and also turns on the switches 206S and 208S to energize the filaments 206A and 208A of the halogen heaters 206 and 208 for heat generation, thereby starting warm-up of the fixing device 200.

Simultaneously with the start of heating of the fixing roller 202, the fixing roller 202 begins rotating at the same peripheral speed of 178 mm/sec as at the time of image outputting, and the pressure roller 204 is rotated in a manner following the fixing roller 202. The halogen heater 206 within the fixing roller 202 is caused to generate heat with a power consumption of 600W, while the halogen heater 208 within the pressure roller 204 is caused to generate heat with a power consumption of 300W. The halogen heaters 206 and 208 have their heat distributions combined so that when A4-sized pieces of paper (transverse) are continuously passed, the temperature distribution in the axial direction of the surface of the fixing roller 202 is almost constant. When the fixing roller 202 is to be heated at a stroke without passage of paper, as at the warm-up of the fixing device 200, the temperature in the middle region of the roller rises at much higher a rate than the non-paper-passage region temperature, because heat conduction to the thermistor 209 located at the farthest end portion of the heating region does not catch up with the heat generation in the roller middle region.

Figure 6:
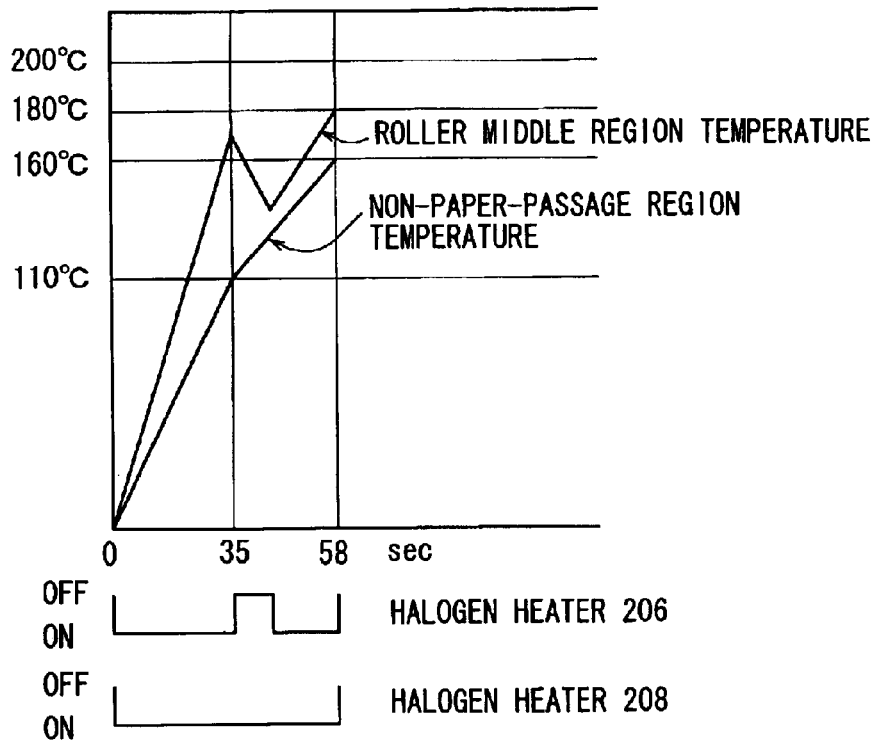
FIG. 6 is a diagram showing the relationship between the ON-OFF timings of the halogen heaters in a warm-up of the fixing device and the temperature of a middle region and the temperature of a non-paper-passage region in the fixing roller (i.e., an example of the present invention)

FIG. 6 diagrammatically shows the relationship between the ON(energization)-OFF(shutoff of energization) timings of the halogen heaters 206 and 208 in warm-up of the fixing device 200 and the roller middle region temperature and the non-paper-passage region temperature in the fixing roller 202. At 35 seconds after start of warm-up, the non-paper-passage region temperature reaches a temperature of 110° C., a predetermined value. At this point in time, the roller middle region temperature has risen to 170° C. At this time point, the controller 210 exercises control so as to switch off the energization of the halogen heater 206 (turn off the switch 206S) for 8 seconds. As a result, the roller middle region temperature once lowers to 140° C., while the non-paper-passage region temperature rises to 130° C. After a lapse of the 8 seconds, the controller 210 turns on the switch 206S to restore the energization of the halogen heater 206. The controller 210 energizes both of the halogen heaters 206 and 208, and causes them to generate heat, for 15 seconds since the restoration of energization of the halogen heater 206, whereafter the controller 210 brings the warm-up to a halt. That is, a total time of 58 seconds is required for the warm-up. At completion of the warm-up, the roller middle region temperature is 180° C., and the non-paper-passage region temperature is 160° C.

In the foregoing embodiment of the present invention, the controller 210 completes warm-up at a time when the predetermined warm-up time has elapsed. This time control can be easily exercised by confirming, beforehand, the relationship between energization control over the halogen heaters 206 and 208 and the surface temperature of the fixing roller 202. Moreover, the time control is useful for practical purposes, because this control itself is easy and the surface temperature of the fixing roller 202 can be controlled accurately.

As described earlier, the copier body 102 incorporates the temperature detection sensor 212 for detecting the ambient temperature. The above-described warm-up time of 58 seconds is automatically adjusted by the controller 210 based on the ambient temperature detected by the time detection sensor 212. That is, the controller 210 sets the warm-up time at 58 seconds in an environment at 15° C. or higher, at 65 seconds in an environment at 5° C. to lower than 15° C., and at 70 seconds in an environment at lower than 5° C. This warm-up time is sufficient for ensuring the non-paper-passage region temperature of 160° C. or higher. Regardless of changes in the environmental temperature, moreover, the warm-up of the fixing device can be performed preferably within a proper period of time, with the surface temperature of the fixing roller 202 being maintained always at an appropriate predetermined value.

Furthermore, the switch-off of the halogen heater 206 lasting for 8 seconds makes it possible to prevent the excessive elevation of the roller middle region temperature, and effectively acts to keep the roller middle region temperature down to lower than 200° C. in the embodiment. Moreover, the surface temperature in the axial direction of the fixing roller 202 can be uniformized. The entire warm-up time, and the OFF-time of the halogen heater 206 are set values determined by investigating, beforehand, the relationship between the ambient temperature and the warm-up time in the copier 100. These set values are designed to complete warm-up in a state where the non-paper-passage region temperature is 160° C. or higher and the roller middle region temperature is lower than 200° C. By making the non-paper-passage region temperature 160° C. or higher, it is ensured that the paper-passage region temperature, as a whole, be 160° C. or higher. Furthermore, the surface temperature of the fixing roller in the paper-passage region is adjusted in the range of 160° C. to lower than 200° C., thereby ensuring warm-up capable of completely preventing a local hot offset and a failure in fixing.

Figure 7:
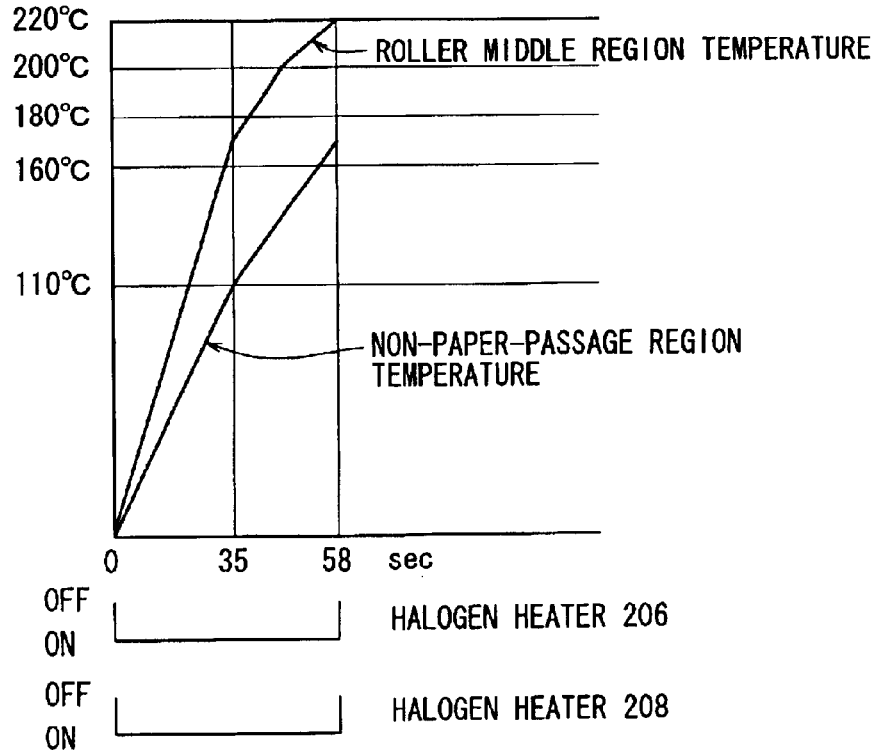
FIG. 7 is a diagram showing the relationship between the ON-OFF timings of the halogen heaters in a warm-up of the fixing device and the temperature of a middle region and the temperature of a non-paper-passage region in the fixing roller (i.e., a comparative example relative to the above example).

As a control example, FIG. 7 shows changes in the roller middle region temperature and the non-paper-passage region temperature obtained when the halogen heaters 206 and 208 are controlled so as to be continuously kept in switch-on for 58 seconds in warm-up. According to this control, the roller middle region temperature rose to 220° C. and the non-paper-passage region temperature rose to 170° C. at completion of warm-up. It is seen that whatever time elapses after start of warm-up, there is no heating time ensuring a range in which the roller middle region temperature is 200° C. or lower and the non-paper-passage region temperature is 160° C. or higher.

In the above-described embodiment according to the present invention, the temperature distribution of the paper-passage region including the middle region of the fixing roller, and the target temperature after completion of warm-up for the non-paper-passage region temperature are set in the range of 160° C. to 200° C. However, the present invention is not restricted thereto, and the optimal range can be set appropriately in consideration of the fusion characteristics, the speed of image outputting, and the power consumption and heat generation pattern of the halogen heater. For example, the range of 130 to 210° C. can be set preferably.

In the above embodiment according to the present invention, the halogen heater 206 for emphatically heating the middle region consumes 600W, and the halogen heater 208 for emphatically heating the opposite-end regions consumes 300W. However, the present invention is not restricted thereto, and the heat consumptions may be set appropriately in consideration of the temperature distribution of the paper-passage region including the roller middle region, and the target temperature for the non-paper-passage region temperature. Besides, the allocation pattern for electric power in the axial direction of each halogen heater can be set appropriately.

In the embodiment according to the present invention, the warm-up time is set automatically according to the ambient temperature, namely, at 58 seconds in an environment at 15° C. or higher, at 65 seconds in an environment at 5° C. to lower than 15° C., and at 70 seconds in an environment at lower than 5° C. However, the present invention is not restricted thereto, and the warm-up time may be set appropriately depending on the temperature distribution of the paper-passage region including the roller middle region at completion of warm-up, and the target temperature after completion of warm-up for the non-paper-passage region temperature. Where necessary, the time need not be set beforehand, but there may be a system under which warm-up is completed based on the detection temperature of the non-paper-passage region. In this case, the controller 210 cuts off power supply to the halogen heater 206 for a predetermined period of time during warm-up, then restores power supply to the halogen heater 206, and at a time when the temperature of the non-paper-passage region detected by the thermistor 209 reaches a predetermined value, the controller 210 cuts off power to the halogen heaters 206 and 208, thereby completing warm-up. According to this embodiment, the surface temperature of the fixing roller 202 can be controlled conveniently, easily and accurately by mounting the thermistor in the non-paper-passage region.

In the above embodiment according to the present invention, the OFF-time, during warm-up, of the halogen heater 206 responsible for emphatic heating of the middle region is set at 8 seconds. However, the present invention is not restricted thereto, and this OFF-time may be set appropriately in consideration of the temperature distribution of the paper-passage region including the roller middle region, the target temperature for the non-paper-passage region temperature, and the allocation pattern of electric power in the axial direction of each of the halogen heaters 206 and 208. Besides, the temperature at which temporary switch-off of the halogen heater 206 is carried out is set at 110° C. However, the present invention is not restricted thereto, and the switch-off temperature may be set appropriately in consideration of the temperature distribution of the paper-passage region including the roller middle region, the target temperature for the non-paper-passage region temperature, and the allocation pattern of electric power in the axial direction of each of the halogen heaters.

In the above embodiment according to the present invention, the roller body 202*a* of the fixing roller 202 is made of aluminum. However, the present invention is not limited thereto, and a metal such as iron, copper, nickel or stainless steel can also be used. The wall thickness of the roller body 202*a* is set at 1 mm, but the present invention is not limited thereto, and the range of 0.5 mm to 3 mm can be used preferably. The release layer on the surface of the roller body 202*a* is formed from PTFE (polytetrafluoroethylene), but can be selected from other fluoroplastics, such as PFA (tetrafluoroethyleneperfluoroalkyl vinyl ether copolymer), PVF (polyvinyl fluoride), and ECTFE (ethylene-chlorotrifluoroethylene copolymer). The wall thickness of this release layer is set at 15 $\mu$m, but can be used preferably from the range of 10 to 100 $\mu$m.

In the above embodiment according to the present invention, the thickness of the elastic layer 204*b* coated on the surface of the mandrel 204*a* in the pressure roller 204 is set at 6.5 mm. However, the present invention is not limited thereto, and the range of 2 to 15 mm can be used preferably. The silicone rubber forming the elastic rubber 204*b* is that having an Asker C hardness of 25 degrees, but the present invention is not limited thereto, and natural rubber having an Asker C hardness of 5 to 90 degrees can be used preferably. Furthermore, the release layer coated on the surface of the elastic layer 204*b* is a tube of PFA (tetrafluoroethylene-perfluoroalkyl vinyl ether copolymer), but the present invention is not limited thereto, and the material for the release layer can be selected from fluoroplastics, such as PTFE (polytetrafluoroethylene), PVF (polyvinyl fluoride), and ECTFE (ethylene-chlorotrifluoroethylene copolymer). In addition, the wall thickness of this release layer is set at 70 $\mu$m, but the present invention is not limited thereto, and the range of 20 to 100 $\mu$m can be used preferably.

In the above-described embodiment, the image forming apparatus according to the present invention is composed of the in-body paper delivery type copier 100. However, the present invention can be applied to a copier or laser printer of other construction. In the aforementioned embodiment, moreover, the most typical paper is exemplified as a material on which to record an image. However, the recording material may be a sheet member capable of having an image recorded thereon, so that the paper refers to a sheet member capable of having an image recorded thereon.

What we claim is:

1. An image forming apparatus comprising:

a fixing device including a fixing roller, a pressure roller pressed into contact with said fixing roller, and temperature detection means in contact with a non-paper-passage region on a surface of said fixing roller, said fixing roller incorporating first heating means whose heat distribution based on an axial direction of said fixing roller is set such that heat in a middle region thereof is higher than heat in opposite-end regions thereof, and second heating means whose heat distribution based on the axial direction of said fixing roller is set such that heat in opposite-end regions thereof is higher than heat in a middle region thereof; and a controller for controlling power supply to said first heating means and said second heating means, and wherein said controller starts power supply to said first heating means and said second heating means to start warm-up of said fixing device, and cuts off power supply to said first heating means for a predetermined period of time during said warm-up.

2. The image forming apparatus according to claim 1, wherein said controller cuts off power supply to said first heating means for the predetermined period of time at a time when a temperature of said non-paper-passage region detected by said temperature detection means reaches a predetermined value during said warm-up.

3. The image forming apparatus according to claim 1, wherein said controller cuts off power supply to said first heating means for the predetermined period of time during said warm-up, then restores power supply to said first heating means, and continues power supply to said first heating means and said second heating means until a predetermined time when said warm-up is completed.

4. The image forming apparatus according to claim 3, wherein ambient temperature detection means is provided, and said controller sets a duration of said warm-up based on ambient temperature detected by said ambient temperature detection means.

5. The image forming apparatus according to claim 1, wherein said controller cuts off power supply to said first heating means for the predetermined period of time during said warm-up, then restores power supply to said first heating means, and at a time when a temperature of said non-paper-passage region detected by said temperature detection means reaches a predetermined value, cuts off power supply to said first heating means and said second heating means, thereby completing said warm-up.

* * * * *